United States Patent [19]

Wilson

[11] Patent Number: 5,044,637

[45] Date of Patent: Sep. 3, 1991

[54] GOLF CLUB HEAD

[76] Inventor: Richard C. Wilson, 2066 Vista, Arcadia, Calif. 91006

[21] Appl. No.: 605,562

[22] Filed: Oct. 29, 1990

[51] Int. Cl.[5] ..... A63B 53/04; A63B 69/36

[52] U.S. Cl. ..... 273/164; 273/167 H; 273/169

[58] Field of Search ..... 273/167 H, 167 R, 167 D, 273/167 E, 167 F, 167 G, 167 J, 167 K, 169, 170, 171, 172, 175, 164

[56] References Cited

U.S. PATENT DOCUMENTS

| | | | |
|---|---|---|---|
| D. 202,715 | 11/1965 | Solheim | D34/5 |
| D. 203,512 | 1/1966 | Solheim | D34/5 |
| D. 207,227 | 3/1967 | Solheim | D34/5 |
| D. 209,215 | 11/1967 | Long | D34/5 |
| D. 228,563 | 10/1973 | Brower | D34/5 GH |
| D. 230,293 | 2/1974 | Gall | D34/5 GC |
| D. 230,294 | 2/1974 | Gall | D34/5 GC |
| D. 234,206 | 1/1975 | Cook | D34/5 GH |
| D. 234,207 | 1/1975 | Cook | D34/5 GH |
| D. 234,209 | 1/1975 | Bizovi | D34/5 GH |
| D. 239,964 | 5/1976 | Wilson | D34/5 GH |
| 1,690,388 | 11/1928 | Waldron | 273/167 E X |
| 1,916,792 | 7/1933 | Hadden | 273/167 R |
| 2,447,967 | 8/1948 | Stone | 273/78 |
| 3,079,157 | 2/1963 | Turner | 273/167 R |
| 3,166,320 | 1/1965 | Onions | 273/80 C |
| 3,655,188 | 4/1972 | Solheim | 273/77 A |
| 3,779,398 | 12/1973 | Hunter | 273/183 D |
| 3,810,631 | 5/1974 | Braly | 273/167 A |
| 4,836,550 | 6/1989 | Kobayashi | 273/167 H |

*Primary Examiner*—George J. Marlo

*Attorney, Agent, or Firm*—Poms, Smith, Lande & Rose

[57] ABSTRACT

A cavity back driver has a club head body and a hosel. The club head body has a body shell and a substantially flat front face. The body shell has a generally arcuate lower flange and a generally curvilinear upper flange. The lower flange has a flattened portion generally midway therein. The face is canted from a plane normal to the flattened portion by a selected angle. Each of the lower flange and the upper flange extend rearwardly from the face to form the cavity back. The lower flange extends substantially further rearwardly than the upward flange and tapers inwardly towards a juncture with the upper flange at each end. The extension and tapering of the lower flange is selected so that the center of mass of the club head body is foreweighted and located a selected distance behind the center of the face. The hosel has a shaft portion which receives the shaft of the golf club and a club body portion integrally interconnected to the body shell proximate one juncture of the lower flange and the upper flange.

12 Claims, 1 Drawing Sheet

GOLF CLUB HEAD

FIELD OF THE INVENTION

The present invention relates generally to golf club heads and more particularly to a cavity back driver which has a flat face and is foreweighted.

BACKGROUND OF THE INVENTION

As is well known, golf clubs are generally of two types. The "woods" which are distance clubs and the "irons." Wood golf clubs basically include a shaft having a grip portion on one end and the head attached to the other end. Most wood golf club heads are generally rounded to their rear with their face having a slight bulge therein.

The face bulge is provided to impart a spin to the ball to correct the course of the ball should the ball be stricken from an off-center portion of the face. The face bulge has a selected radius for each numbered wood club head. This radius further depends if the club head is center weighted, fore weighted or back weighted. Table 1, taken from "Golf Club Design, Fitting, Alteration and Repair" by Ralph Maltby, sets forth the face bulge radius for wood clubs numbered 1-7 depending on their center of gravity. As can be seen from Table 1, the further that the weight is moved to the back of the club, or away from the face, the more pronounced the face bulge (decreasing radius) becomes.

TABLE 1

| | Horizontal Face Bulge Radius - Wood Clubs | | |
|---|---|---|---|
| Club No. | Center Weighted Clubs | Fore Weighted Clubs | Back Weighted Clubs |
| 1 | 10" R. | 11" R. | 8" or 9" R. |
| 2. | 12" R. | 13" R. | 10" or 11" R. |
| 3. | 12" R. | 13" R. | 10" or 11" R. |
| 4. | 12" R. | 13" R. | 10" or 11" R. |
| 5. | 14" R. | 15" R. | 12" or 13" R. |
| 6. | 14" R. | 15" R. | 12" or 13" R. |
| 7. | 16" R. | 17" R. | 14" or 15" R. |

Center weighted clubs are weighted under the sole plate at the approximate middle of the club head. Drivers with an empty weight hole to reduce club head weight or with no hole, if the weight is not required, are still considered center weighted as this feature will usually only change the center of gravity in the up and down plane of the club head and not from the face to back for purposes of Table 1. Foreweighted clubs are either weighted in or behind the face insert or use heavy face inserts such as steel or brass. Also, foreweighted clubs sometimes have the weight holes under the sole plate drilled closer to the face. Backweighted clubs usually have less or no weight under the sole plate. The additional head weight is added to the back of the wood either as a brass back weight or recessed lead back weight.

Another consideration in golf club head design is the loft angle of the head. The loft angle is defined as the tilt of the face backwards from a plane normal to the sole plate. This tilt varies depending on the vertical trajectory desired for the golf ball. The loft angle increases with increasing club number so that the vertical trajectory of the ball increases as the club number increases. The standard driver loft is 11° for drivers fabricated from wood.

Metal woods have recently become popular. Because of their lower center of gravity, there has been a trend towards stronger lofts (decreasing loft angles). All drivers, whether wood or metal, have a loft angle less than 14°. For comparison, the standard loft angle on the one iron is 17°. It is to be noted that even metal woods still require a face bulge. It would be highly desirable to provide a "wood" head with a substantially flat face to eliminate deflection of the ball along a path defined by the stroke of the club head when struck from an off center portion of the club head face.

SUMMARY OF THE INVENTION

In accordance with the present invention, an improved unitarily constructed metal "wood" head of a cavity back design is provided. The cavity back driver has a club head body and a hosel. The club head body has a body shell which forms the cavity back and a substantially flat front face. The body shell has a generally arcuate lower flange and a generally curvilinear upper flange. The lower flange has a flattened portion generally midway therein. The face is canted from a plane normal to the flattened portion by a selected angle. Each of the lower flange and the upper flange extend rearwardly from the face to surround the cavity back. The lower flange extends substantially further rearwardly than the upper flange and further tapers inwardly towards a juncture with the upper flange at each of their respective ends. The extension and tapering of the lower flange is selected so that the center of mass of the club head body is foreweighted and is further located a selected distance behind the center of the face. The hosel has a shaft portion which receives the shaft of a golf club and a club body portion integrally interconnected to the body shell proximate one juncture of the lower flange and the upper flange.

It is a feature of the present invention that, with the cavity back driver being foreweighted, its face is substantially flat. This feature is in contrast to the prior art wherein even with foreweighting a face bulge is still required. See Table 1. It is another feature of the present invention that the lower flange is easily machined for fine tuning the center of gravity of the cavity back driver. An advantage of the flat front face of the cavity back driver is that if the ball is hit off center with respect to the center of mass of the club head, the ball will still travel in a straight line as opposed to the deflection from straight ahead travel (defined by the path of the head) imposed by the face bulge of the prior art wood club heads.

These and other objects, advantages and features of the present invention will become readily apparent to those skilled in the art from a study of the following Description of an Exemplary Preferred Embodiment when read in conjunction with the attached Drawing and appended Claims.

DESCRIPTION OF AN EXEMPLARY PREFERRED EMBODIMENT

Figure 5:
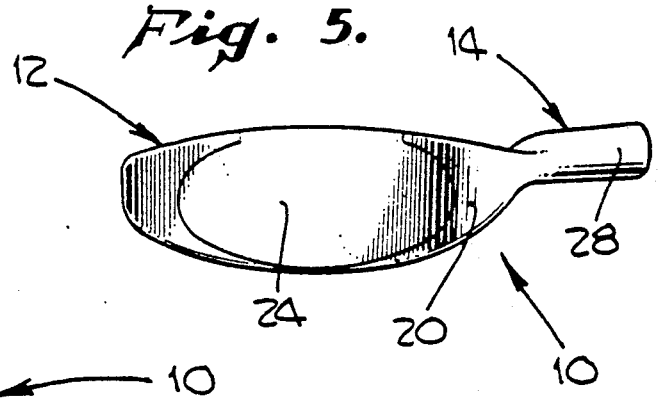
FIG. 5 is a bottom plan view of the cavity back driver of FIG. 1.
Figure 2:
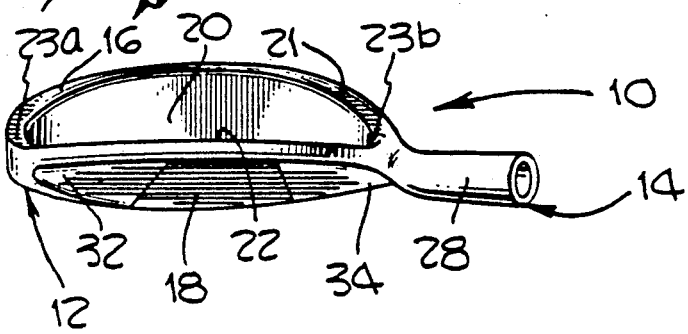
FIG. 2 is a top plan view of the cavity back driver of FIG. 1.
Figure 3:
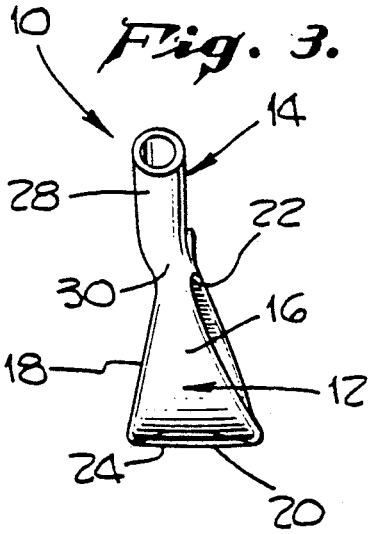
FIG. 3 is a right side elevational view of the cavity back driver of FIG. 1.
Figure 1:
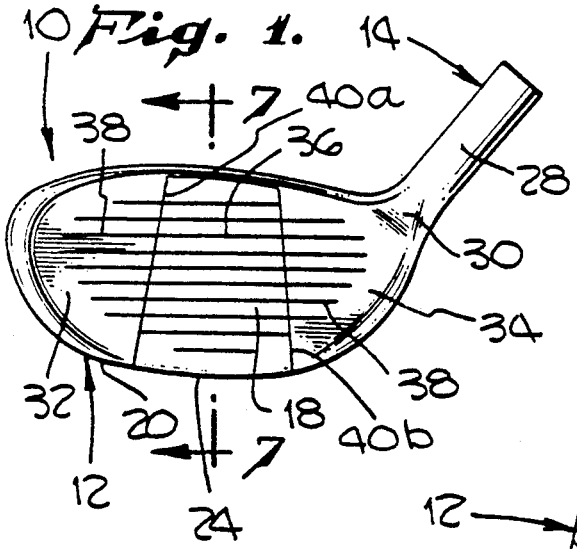
FIG. 1 is a front elevational view of a cavity back driver constructed according to the principles of the present invention.

Referring now to the Drawing, there is shown a cavity back driver 10 constructed according to the principles of the present invention. The cavity back driver 10 has a club head body 12 and a hosel 14. The cavity back driver 10 is constructed from a suitable metal or a plastic composite material commonly used for golf club heads. The heads body 12 and the hosel 14 are unitarily fabricated to provide added structural strength.

The club head body 12 has a body shell 16 and a generally flat front face 18. The body shell 16 has a generally arcuate lower flange 20 and a generally curvilinear upper flange 22.

The lower flange 20 has a flattened portion 24 generally midway therein. The face 18 is canted from a plane normal to the flattened portion by a selected angle. The selected angle is chosen to be less than 14°. These are the face angles used for drivers.

Each of the lower flange 20 and the upper flange 22 extend rearwardly from the front face 18 to form a cavity back 26. The lower flange 20 extends substantially further rearwardly than the upper flange 22. Furthermore, the tapering of the lower flange 20 along its rearward edge 21 is inward towards each juncture 23*a*, 23*b* with the upper flange 22, these junctures 23*a*, 23*b* occurring at the ends of the upper flange 22 and lower flange 20. The extension and tapering of the rearward edge 21 of lower flange 20 is selected so that the center of mass of the club head body 12 is foreweighted, as described in greater detail hereinbelow.

Figure 7:
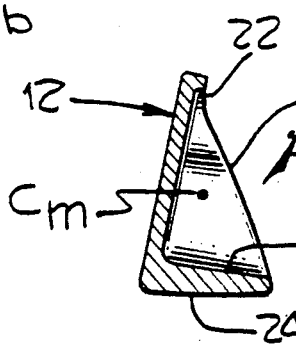
FIG. 7 is a cross-sectional view taken along line 7—7 of FIG. 1.
Figure 6:
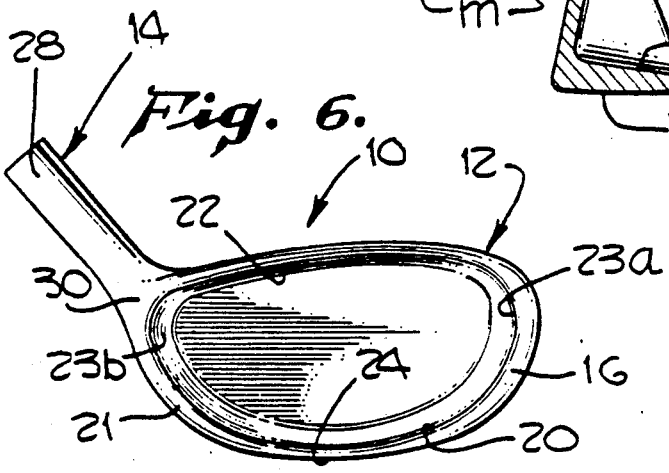
FIG. 6 is a rear elevational view of the cavity back driver of FIG. 1.
Figure 4:
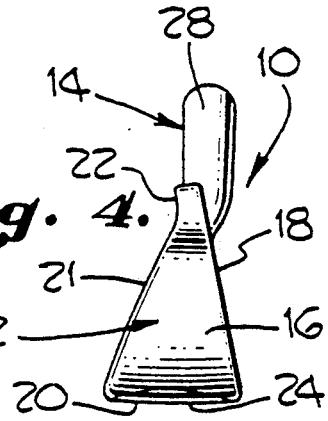
FIG. 4 is a left side elevational view of the cavity back driver of FIG. 1.

In the cavity back driver 10 described hereinabove, the rearward edge 21 of the lower flange 20 is extended and tapered so that the center of mass ($C_m$, FIG. 7) is not more than ⅜ of an inch behind the front face 18 at its center point. Furthermore, the center of mass $C_m$ is not more than ½" behind the furthest projection of the front face 18 at the juncture with the bottom flange 20. This center of mass $C_m$ is obtained when the extension of the lower flange 20 is 1⅛" at its flattened sole portion 24. The center of mass $C_m$ in the cavity back driver 10 as set forth above differs significantly in comparison to the prior art wherein the center of mass is usually 1" behind the face.

The hosel 14 has a shaft portion 28 which is adapted to receive a shaft of a golf club (not shown) and a club body portion 30. The club body portion 30 is integrally interconnected to the body shell 16 proximate the juncture 23*b*of the lower flange 20 and the upper flange 22. The club body portion 30 is further shaped to provide rigidity and to minimize the probability of stress fractures at the interconnection with the body shell 16.

Completing the description of the cavity back driver 10, the face 18 has a toe portion 32, a heel portion 34 and a middle portion 36. The middle portion 36 is disposed between the toe portion 32 and the heel portion 34. The toe portion 32 has a height greater than the heel portion 34. The club body portion 30 of the hosel 18 is fabricated integrally with the heel portion 34.

The face 18 further has a plurality of horizontal face lines 38, the function of which is well known. The face lines 38 extend across each of the toe portion 32, middle portion 36 and heel portion 34. A pair of generally vertical face lines 40*a*, 40*b* delineate the middle portion 36 from the toe portion 32 and heel portion 34. In a preferred embodiment of the present invention, the middle portion 36 is visually contrasted from the toe portion 32 and heel portion 34. This visual contrast facilitates the golfer aligning the stroke so that the middle portion 36 strikes the golf ball as desired.

The face 18 is 3½" wide and its middle portion 36 has a height of 1⅝". When constructed as above described, the cavity back driver 10 has a weight in the range of 195 to 220 grams.

There has been described hereinabove a novel cavity back driver golf club head wherein flanges which form a cavity back provide for weighing and adjusting the center of mass of the club and which is further foreweighted and has a flat face. Those skilled in the art may now make numerous uses of and departures from the above described Exemplary Preferred Embodiment without departing from the inventive concepts disclosed herein. Accordingly, the present invention is to be defined solely by the scope of the following claims.

I claim:

1. A cavity back wood type driver comprising:

a club head body including a body shell and a substantially flat front ball striking face, said body shell having a generally arcuate lower flange and a generally curvilinear upper flange, said lower flange having a sole portion generally midway therein, said face being canted at an angle of less than 14° from a vertical plane normal to a horizontal plane tangent to said sole portion each of said lower flange and said upper flange extending rearwardly from said front face to form a cavity back, said lower flange extending substantially further rearwardly than said upper flange and tapering inwardly towards a juncture at each of its ends with said upper flange wherein the extension and tapering of said lower flange is selected so that a center of mass of said club head body is foreweighted and is further located a selected distance not more than ⅜ inch behind a center of said face; and a hosel having a shaft portion which receives a shaft of a golf club and a club body portion integrally interconnected to said body shell proximate one juncture of said lower flange and said upper flange.

2. A cavity back driver as set forth in claim 1 wherein said center of mass is not more than ½" behind a furthest projection of said front face at a juncture with said bottom flange.

3. A cavity back driver as set forth in claim 1 wherein said face has a plurality of horizontal face lines.

4. A cavity back driver as set forth in claim 1 wherein said face has a toe portion, heel portion and a middle portion disposed between said toe portion and said heel portion, said toe portion having a height greater than said heel portion.

5. A cavity back driver as set forth in claim 4 wherein said club body portion is integral with said heel portion.

6. A cavity back driver as set forth in claim 4 wherein said middle portion is visually contrasted from each of said toe portion and said heel portion.

7. A cavity back driver as set forth in claim 4 wherein said face includes a pair of generally vertical lines to delineate said middle portion from each of said toe portion and said heel portion.

8. A cavity back driver as set forth in claim 1 wherein said driver has a weight in the range of 195 to 220 grams.

9. A cavity back driver as set forth in claim 1 wherein said club head body and said hosel are of unitary construction.

10. A cavity back wood type driver of unitary construction comprising:

a club head body including a body shell and a substantially flat front ball striking face, said body shell having a generally arcuate lower flange and a generally curvilinear upper flange, said lower flange having a sole portion generally midway therein, each of said lower flange and said upper flange extending rearwardly from said front face to form a cavity back, said lower flange extending substantially further rearwardly than said upper flange and tapering inwardly towards a juncture at each of its ends with said upper flange wherein the extension and tapering of said lower flange is selected so that a center of mass of said club head body is foreweighted and is further located a selected distance not more than ⅜ inch behind a center of said face, said face being canted from a vertical plane normal to a horizontal plane tangent to said sole said portion by a selected angle less the 14°, said face having a toe portion, a heel portion, a middle portion disposed between said toe portion and said heel portion, a pair of generally vertical lines to delineate said middle portion from each of said toe portion and said heel portion, and a plurality of horizontal face lines extending across each of said toe portion, said middle portion and said heel portion; and a hosel having a shaft portion which receives a shaft of a golf club and a club body portion integrally interconnected to said body shell proximate one juncture of said lower flange and said upper flange at said heel portion.

11. A cavity back driver as set forth in claim 10 wherein said center of mass is not more than ½" behind a furthest projection of said front face at a juncture with said bottom flange.

12. A cavity back driver as set forth in claim 10 wherein said driver has a weight in the range of 195 to 220 grams.

* * * * *